United States Patent [19]

Hazard

[11] 4,081,113

[45] Mar. 28, 1978

[54] CHILD RESISTANT DISPENSING CLOSURE

[75] Inventor: Robert E. Hazard, N. Kingstown, R.I.

[73] Assignee: Polytop Corporation, Slatersville, R.I.

[21] Appl. No.: 665,727

[22] Filed: Mar. 11, 1976

[51] Int. Cl.[2] ..... B65D 25/46; B65D 47/06

[52] U.S. Cl. ..... 222/534; 222/536

[58] Field of Search ..... 222/534, 536, 533

[56] References Cited

U.S. PATENT DOCUMENTS

| | | | |
|---|---|---|---|
| 2,938,653 | 5/1960 | Church et al. | 222/536 |
| 2,971,664 | 2/1961 | Jacob | 222/536 X |
| 3,265,256 | 8/1966 | Chaber et al. | 222/534 |
| 3,718,238 | 2/1973 | Hazard et al. | 222/536 |
| 3,851,805 | 12/1974 | Hazard | 222/534 |
| 3,873,005 | 3/1975 | Hazard | 222/536 X |

FOREIGN PATENT DOCUMENTS

| | | | |
|---|---|---|---|
| 1,342,589 | 9/1963 | France | 222/531 |

*Primary Examiner*—Robert B. Reeves
*Assistant Examiner*—Frederick R. Handren
*Attorney, Agent, or Firm*—Edward D. O'Brian

[57] ABSTRACT

A dispensing closure having a cap adapted to be mounted upon a container and a spout mounted on the cap so as to be capable of being moved between an open and closed position can be made child resistant through the use of an engagement structure on the spout such as, for example, a notch in the base of the spout located so that a vertically directed force exerting against the engagement structure will not tend to move the spout from the closed position. The cap and the spout employed should be dimensioned so that the spout is incapable of being manually engaged so as to be manipulated when in the closed position.

8 Claims, 4 Drawing Figures

CHILD RESISTANT DISPENSING CLOSURE

CROSS-REFERENCE TO RELATED PATENTS AND APPLICATIONS

Reference is made to co-pending application Ser. No. 549,720 filed Feb. 13, 1975, by Robert E. Hazard, entitled "CHILD RESISTANT DISPENSING CLOSURE", now U.S. Pat. No. 3,957,181. The entire subject matter of this co-pending application is incorporated herein by reference in the interest of brevity.

Reference is also made to the Robert E. Hazard U.S. Pat. No. 3,884,392, issued May 20, 1975, entitled "CHILD RESISTANT CLOSURE", the Robert E. Hazard U.S. Pat. No. 3,863,818, issued Feb. 4, 1975, entitled "DISPENSING CLOSURE WITH INTEGRAL SPOUT LATCHES", the Robert E. Hazard U.S. Pat. No. 3,851,805, issued Dec. 3, 1974, entitled "CHILD RESISTANT CLOSURES WITH LIMITED SPOUT ACCESSIBILITY", all of which patents issued on applications which were co-pending with said application Ser. No. 549,720. The entire subject matters of these patents are incorporated herein by reference in the interest of brevity.

BACKGROUND OF THE INVENTION

The invention set forth in this specification pertains to new and improved child resistant type dispensing closures.

A dispensing closure is normally considered to consist of a cap adapted to be mounted on or formed integrally with a container and a spout mounted upon the cap so as to be capable of being rotated between a closed position in which an opening to the cap is closed off by the spout and an open position in which the opening is in communication with a passage extending through the spout. Such dispensing closures are more commonly constructed out of a polymer material capable of being temporarily deformed such as polyethylene or polypropylene in such a manner that the parts of such closures can be snapped or popped together. It is well recognized that the constructional details of such closures may vary to significant extents.

The dispensing closure industry has been faced with a significant problem in making dispensing closures of a so-called "child resistant" character in response to a gradually increasing demand for such closures. In generalized terms the expression "child resistant" is employed in the closure field to designate closures which can be opened by the average adult when necessary, but which are sufficiently difficult to open so that there is no reasonable chance of their being opened by a comparatively young child and/or an adult having less than normal capabilities. The need for child resistant dispensing closures has resulted in the development of an extremely large number of different types of such closures. Many of such closures are illustrated in the appropriate patent literature.

Because of economic considerations manufacturers have attempted to provide child resistant closures which are closely related to prior non-child resistant dispensing closures so as to avoid the necessity of making completely new molds or dies for the production of such closures. In other words, manufacturers have desired to modify existing molds for the production of dispensing closures in such a manner that these molds will produce parts which, when assembled together, will provide a dispensing closure of a child resistant nature. An understanding of the present invention is not believed to require a detailed explanation of all of such efforts.

An example of one such effort is indicated in the co-pending U.S. patent application Ser. No. 549,720 which has issued as U.S. Pat. No. 3,957,181. The closure set forth in this patent utilizes a spout which is rotatably mounted in the body of a cap in such a manner that when closed the spout is located in a groove in a position in which it cannot be manually engaged so as to be rotated. In the structure set forth in this patent the spout is provided with a "means" or structure located so as to be capable of being engaged by an implement applied from above the closure so that force exerted through the implement against the spout will rotate the spout to a sufficient extent so that in turn it can be manually engaged to be further rotated to a substantially vertically extending open position. Although structures of this type are utilitarian and are considered to be of a child resistant nature they are believed to have certain inherent drawbacks or limitations.

One of these is that a child playing with such a closure is apt to exert either a vertical force or a force having a predominantly vertical component on such a closure. When this occurs the spout is rotated to a limited degree which is apt to attract the attention of a child so as to cause the child to further investigate the structure by manipulating the spout. If this should happen, there is danger of the spout being opened. Further, structures as are set forth in the aforenoted patent have been designed so as to accommodate an extending enlargement on the spout within a cavity within the cap. Although such a structure is useable it does not effectively preclude air from the passage within the spout when the spout is in a closed position.

The reasonable exclusion of air from a spout in a dispensing closure when the spout is in a closed position is considered to be desirable for several reasons. Such exclusion will tend to minimize contamination within the interior of the spout. Further, dispensing closures are apt to be utilized with somewhat viscous materials which will not flow readily. Such materials may be held within the spout as the spout is rotated from an open to a closed position. The ends of the spout should be reasonably excluded from the ambient air in order to prevent any such material from drying out within the spout and/or from gradually flowing from the spout if the spout is in a non-horizontal position when closed.

BRIEF SUMMARY OF THE INVENTION

A broad object of the invention of this application is to provide new and improved dispensing closures. More specifically the invention is to provide new and improved child resistant dispensing closures which are closely related to those closures indicated in said application Ser. No. 549,720, now U.S. Pat. No. 3,957,181, but which are more desirable than closures as are set forth in this patent. A further object of the present invention is to provide child resistant dispensing closures which can be easily and conveniently manufactured at a comparatively nominal cost using molds or dies which have previously been constructed for the production of non-child resistant closures and which have been modified at a minimal cost so as to utilize the principles and features of the present invention.

In accordance with this invention these objectives are achieved by modifying a known type of dispensing closure having a cap and a spout. In such a closure the cap includes a mounting means adapted to be attached to a container, a cap body located on and connected to the mounting means, an elongated groove located within the body, means for rotatably supporting the spout located on the body so that the spout can be rotated about a substantially horizontal axis, an opening leading through the body from within or between the mounting means into the groove adjacent to a first end of the groove, this opening having a substantially vertical axis intersecting the horizontal axis.

In a closure as indicated the spout is an elongated member having ends, a passage extending between the ends and includes means for rotatably supporting the spout located adjacent to a first of these ends engaged with the means for rotatably supporting the spout on the body so that the spout is mounted on the body in such a manner that it can be rotated about the noted horizontal axis between an opened and a closed position, end means located on the first end of the spout for engaging the body adjacent to and around the intersection of the opening in the body so as to make contact with and so as to form a seal between the opening in the spout at all times, the spout extending vertically with the passage in alignment with the opening in the open position, the spout extending within the groove in the closed position, the groove and the spout being of such dimension that in the closed position the spout is incapable of being manually manipulated so as to be moved from the closed position to the opened position.

In a dispensing closure in accordance with this invention a cap and a spout as indicated are modified so as to include the improvement comprising the end means consisting of an end on the spout having an external surface of revolution having its axis coincident with the horizontal axis and an enlargement means for use in engaging said spout with a tool so as to rotate said spout from the closed position to a position in which the spout can be manually engaged so as to be manipulated to the open position, this engagement means being located on the surface of revolution in a position in which it is substantially impossible to apply a vertically directed force to it to rotate the spout from the closed position.

BRIEF DESCRIPTION OF THE DRAWING

Further details of the invention are best indicated with reference to the remainder of this specification and the accompanying drawing in which.

The closures illustrated embody certain operative concepts and principles as are set forth and defined in the appended claims. Inasmuch as these concepts or principles are capable of being easily embodied within a number of different known dispensing closures through the use of routine design skill in the dispensing closure field the invention is to be considered as being limited solely by the noted claims.

DETAILED DESCRIPTION

Figure 1:
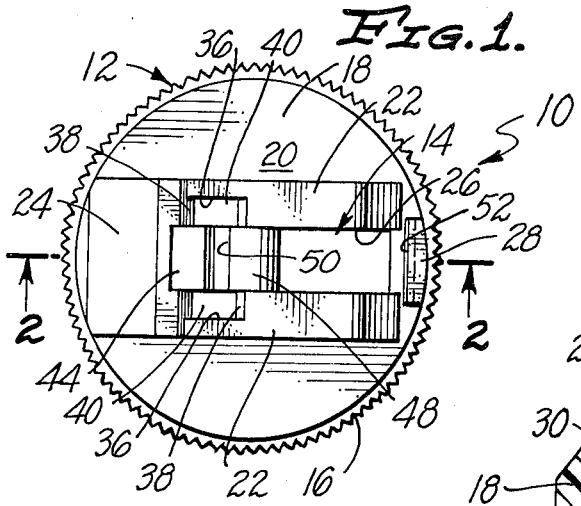
FIG. 1 is a top plan view of a presently preferred embodiment of a child resistant dispensing closure in accordance with this invention.
Figure 2:
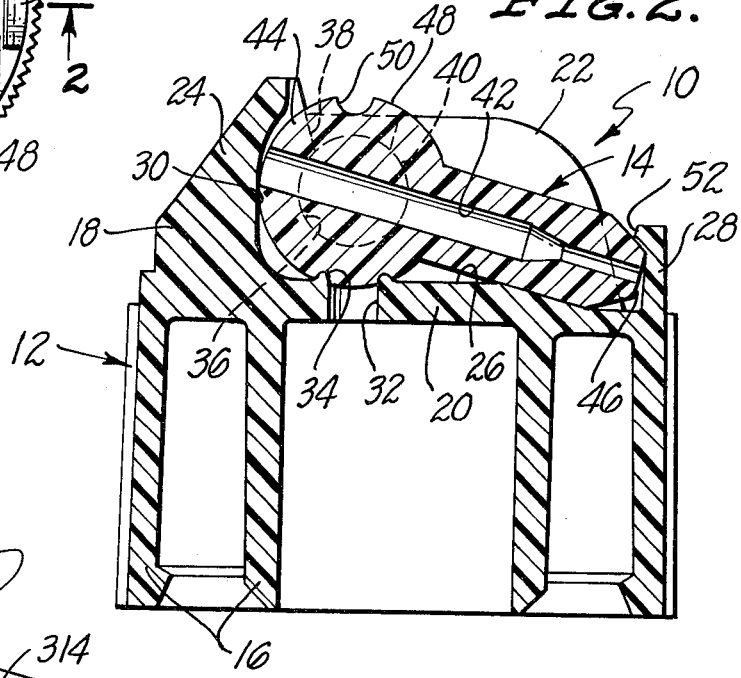
FIG. 2 is a cross-sectional view taken at line 2—2 of FIG. 1.

In FIGS. 1 and 2 of the drawing there is shown a dispensing closure 10 which is constructed so as to include a cap 12 and a spout 14. Both of these parts are preferably formed of a somewhat resilient material capable of being temporarily deformed such as a known polyolefin in accordance with conventional practice in the dispensing closure field so that they may be easily snapped or popped together as they are assembled into an operative relationship as illustrated. The cap 12 includes conventional concentric skirts 16 which serve as mounting means in mounting the closure 10 upon a container. These skirts 16 are preferably of a conventional construction, although if desired they may be formed in a specialized manner as needed in a particular application. Various equivalent mounting means can, of course, be substituted for them.

These skirts 16 are dependent from a cap body 18 which, in the closure 10, include a flat part 20 holding and supporting integrally formed, spaced, parallel side walls 22 which are joined by a rear end wall 24 so as to define an elongated groove 26 located generally between these side walls 22 and above the part 20. The part 20 also holds an integrally formed front or end wall 28 which is spaced from the walls 22 a comparatively short distance. The rear end wall 24 is provided with a partially cylindrical curved surface 30 extending between the side walls 22.

This surface 30 is on the side of a vertically directed cylindrical opening 32 extending through the part 20 remote from the front wall 28. This opening 32 leads into what may be referred to as the interior of the cap—the interior of the most centrally located of the skirts 16. Preferably a small sealing ring 34 of known construction is located on the part 20 so as to extend completely around the opening 32 generally into the groove 26.

Aligned conventional bearing cavities 36 are located in the walls 22 so as to face each other. These bearing cavities 36 have a common horizontally extending axis (not shown) and are located so that this axis is intersected by the vertically extending axis (not shown) of the opening 32. Small slots 38 are also provided in the walls 22 so that cylindrical trunions 40 on the spout 14 may be located within the cavities 36 in a known manner in order to rotatably mount the spout 14 generally within the groove 26. This spout 14 is an elongated member having a passage 44 extending between what may be regarded as a first end 44 and as a second end 46 of the spout 14. The trunions 40 are located upon the first end 44.

This first end 44 is also provided with an enlarged cylindrical end portion 48 which may be termed as an end means. This portion 48 is concentric about the horizontal axis identified in the preceding and is dimensioned so as to fit closely against the surface 30 so as to minimize the exposure of the interior of the passage 42 to the air when the spout 14 is in a closed position as indicated in FIGS. 1 and 2. The second end 46 of the spout 14 is preferably somewhat pointed in character and is located adjacent to the front wall 28 in such a manner that this front wall fits closely adjacent to this end 46 so as to also minimize the exposure of the interior of the passage 42 to the ambient air when the spout 14 is in a closed position.

The various parts of the cap 12 and the spout 14 are preferably dimensioned as indicated so that when the spout 14 is in this closed position it is incapable of being manually engaged or grasped so as to be manually manipulated from this closed position. Preferably, in addition these parts are dimensioned so that there is no reasonable way that the spout 14 may be engaged by a tool or implement other than through the use of a notch 50 located on the end portion 48. The location of this notch 50 is considered relatively important. It extends across the end portion 48 parallel to the horizontal axis previously identified in vertical alignment with the vertical axis of the opening 32 discussed in the preceding.

The notch 50 may be referred to as an engagement means since it is designed so as to be engaged by a tool or implement located in other than a predominantly vertical manner. When a tool or implement is so engaged with the notch 50 such a tool or implement may be used to apply force having a substantial horizontal component to the end portion 48 so as to tend to rotate the spout 14 to a sufficient extent so that it can be manually engaged so as to be further rotated to a substantially vertical orientation with the passage 42 in alignment with the opening 32.

This notch 50 is located in this position so that when a tool or implement is brought into engagement with it from generally above the closure 10 there will be substantially no force exerted upon the spout 14 tending to rotate this spout 14. The rear wall 24 preferably extends far enough around the end portion 48 so that such tool or implement cannot be utilized to completely rotate the spout to such an open position. This is considered desirable in that it necessitates two different types of operations in moving the spout 14 to an open position. The notch 50 is preferably located in a position as shown so that when any tool or implement engaged with it is at an angle greater than about 45° to the plane of the part 20 or to the vertical axis identified in the preceding that any vertical force component exerted through the tool or implement on the spout 14 will not be significantly effective in causing rotation of the spout 14.

If desired, the relative difficulty of rotating the spout 14 from a closed position may be increased by locating on the wall 28 a small overhanging latch 52 which overhangs the second end 46 of the spout 14 when the spout 14 is in a closed position. The configuration of the second end 46 is such as to tend to deflect temporarily the latch 52 and the wall 28 when the spout 14 is being moved into and out of a closed position as illustrated. If desired the latch 52 may be pulled away from the end 46 by deflecting the wall 28 as the spout 14 is being moved into and out of this closed position.

Figure 3:
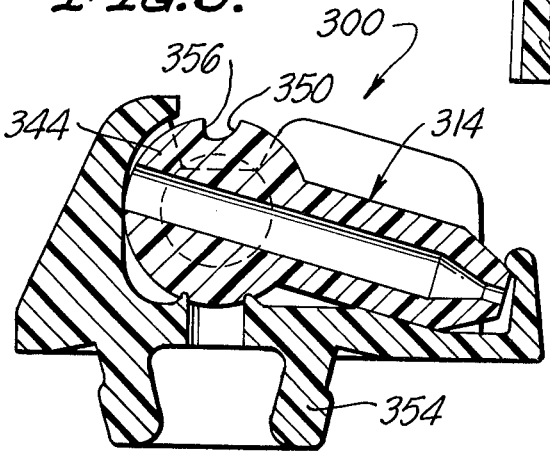
FIG. 3 is a cross-sectional view corresponding to FIG. 2 of a modified dispensing closure in accordance with the invention.
Figure 4:
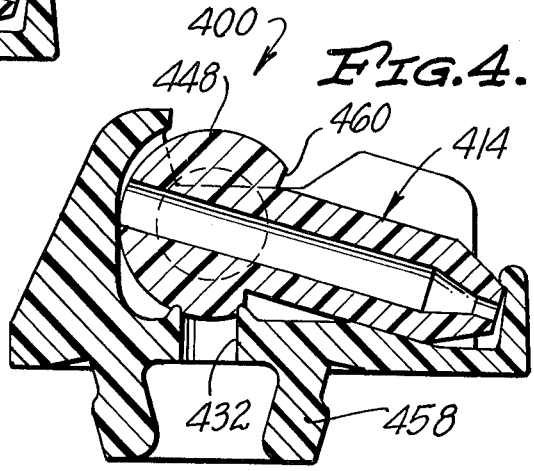
FIG. 4 is a cross-sectional view corresponding to FIG. 2 of a second modified child resistant dispensing closure in accordance with the invention.

In FIGS. 3 and 4 of the drawing there are shown modified dispensing closures 300 and 400 in accordance with this invention which are quite similar to the closure 10. In the interest of brevity those parts of the closures 300 and 400 which are identical to or substantially identical to various previously described parts of the closure 10 are not separately indicated herein and are designated in the drawing and whenever reasonably necessary for explanatory purposes in the remainder of this specification by the numerals previously used to designate such parts preceded by the numerals 3 an 4.

The closure 300 differs from the closure 10 by the substitution of a known type of hollow mounting boss 354 for the previously described skirts 16. The boss 354 is of a conventional design enabling the boss 354 to be popped through an opening in a metal container or the like (not shown). In addition the closure 300 differs from the closure 10 by forming the notch 350 so as to include a substantially vertically extending rear wall 356 facing away from the end 344 of the spout 314 intended to facilitate a tool or implement being used as previously described.

The closure 400 differs from the closure 10 by also substituting for the previously described skirts 16 a boss 458 corresponding to the boss 354. The closure 400 also includes a notch 460 located generally at the juncture of the end portion 448 and of the spout 414. This notch 460 is used in place of the previously described notch 50 and is located on the side of the opening 432 generally remote from the rear wall 424. It is considered that it is relatively easy to locate a tool or implement within this notch 460 by sliding it along the spout 414. When so in place such a tool or implement is located so that there is no way that it can be utilized to exert a downwardly extending force in such a manner as to cause rotation of the spout 414.

Thus, with this location of the notch 460 the force exerted upon the spout 414 must be exerted in a substantially horizontal manner in order to cause any rotation of the spout 414. This is considered to increase the degree of child resistance inherent within a closure as illustrated. The fact that the spout 414 is mounted so as to generally point downwardly when in a closed position in this closure 400 and in the other closures described is considered to also facilitate the application of a substantially horizontal force in order to move the spout 414 and the other spouts 14 and 314 described so that these spouts may be manually engaged to be opened.

I claim:

1. In a dispensing closure having a cap and a spout, said cap including mounting means adapted to be attached to a container, a cap body located on and connected to said mounting means, an elongated groove located within said body, means for rotatably supporting said spout located on said body so that said spout can be rotated about a substantially horizontal axis, an opening leading through said body from within said mounting means into said groove adjacent to a first end of said groove, said opening having a vertical axis intersecting said horizontal axis, said spout being an elongated member having ends, a passage extending between said ends, said spout including means for rotatably supporting said spout located adjacent to a first of said ends, said means for rotatably supporting said spout and said body being in engagement with one another so as to mount said spout on said body so that said spout can be rotated about said horizontal axis between an opened and a closed position, end means located on said first end of said spout for engaging said body adjacent to and around the intersection of said opening and said body so as to make contact with and so as to form a seal between said opening and said spout at all times, said spout extending vertically with said passage in alignment with said opening in said opened position, said spout extending within said groove in said closed position, said groove and said spout being of such dimension that in said closed position said spout is incapable of being directly engaged by the hand of the user so as to be moved from said closed position toward said open position, in which the improvement comprises:

said end means comprising an external surface of revolution having its axis coincident with said horizontal axis, and engagement means for use in engaging said spout with a tool so as to rotate said spout from said closed position to a position in which said spout can be manually engaged so as to be manipulated to said open position said engagement means being located in a position in said surface of revolution in which it is impossible to apply a vertically directed force to it to rotate said spout from said closed position, said engagement means comprising a notch in said spout, said notch comprising an indentation in said spout extending inwardly of said surface of revolution.

2. A dispensing closure as claimed in claim 1 wherein:

said notch is located generally between said end means and the second of said ends of said spout.

3. A dispensing closure as claimed in claim 1 including:

resilient means extending between said body and said spout for impeding rotation of said spout when said spout is in said closed position.

4. A dispensing closure as claimed in claim 1 wherein:

said groove is defined by parallel, spaced side walls and a rear wall, said body includes a front end wall spaced from said side walls, said rear end wall and said front end wall fit closely against the ends of said spout when said spout is in said closed position, said front end wall including a projection serving as a latch overlying said second of said ends of said spout, said front end wall is sufficiently flexible so as to be capable of being deformed so as to permit rotation of said spout from said closed position and into said closed position, said spout and said projection are formed so as to automatically deflect said front end wall when said spout is moved into said closed position, and said engagement means comprises a notch extending parallel to said horizontal axis located in said end means.

5. A dispensing closure as claimed in claim 4 wherein:

said notch is located generally between said end means and the second of said ends of said spout.

6. In a dispensing closure having a cap and a spout, said cap including mounting means adapted to be attached to a container, a cap body located on and connected to said mounting means, an elongated groove located within said body, means for rotatably supporting said spout located on said body so that said spout can be rotated about a substantially horizontal axis, an opening leading through said body from within said mounting means into said groove adjacent to a first end of said groove, said opening having a vertical axis intersecting said horizontal axis, said spout being an elongated member having ends, a passage extending between said ends, said spout including means for rotatably supporting said spout located adjacent to a first of said ends, said means for rotatably supporting said spout and said body being in engagement with one another so as to mount said spout on said body so that said spout can be rotated about said horizontal axis between an opened and a closed position, end means located on said first end of said spout for engaging said body adjacent to and around the intersection of said opening and said body so as to make contact with and so as to form a seal between said opening and said spout at all times, said spout extending vertically with said passage in alignment with said opening in said opened position, said spout extending within said groove in said closed position, said groove and said spout being of such dimension that in said closed position said spout is incapable of being directly engaged by the hand of the user so as to be moved from said closed position toward said open position, in which the improvement comprises:

said end means comprising an external surface of revolution having its axis coincident with said horizontal axis, and engagement means for use in engaging said spout with a tool so as to rotate said spout from said closed position to a position in which said spout can be manually engaged so as to be manipulated to said open position located on said surface of revolution in a position in which it is impossible to apply a vertically directed force to it to rotate the spout from said closed position, said engagement means comprising a notch extending parallel to said horizontal axis located in said end means, said notch being located in vertical alignment with said opening when said spout is in said closed position.

7. A dispensing closure as claimed in claim 6 wherein:

said notch includes a vertically extending rear wall facing away from said first of said ends of said spout.

8. In a dispensing closure having a cap and a spout, said cap including mounting means adapted to be attached to a container, a cap body located on and connected to said mounting means, an elongated groove located within said body, means for rotatably supporting said spout located on said body so that said spout can be rotated about a substantially horizontal axis, an opening leading through said body from within said mounting means into said groove adjacent to a first end of said groove, said opening having a vertical axis intersecting said horizontal axis, said spout being an elongated member having ends, a passage extending between said ends, said spout including means for rotatably supporting said spout located adjacent to a first of said ends, said means for rotatably supporting said spout and said body being in engagement with one another so as to mount said spout on said body so that said spout can be rotated about said horizontal axis between an opened and a closed position, end means located on said first end of said spout for engaging said body adjacent to and around the intersection of said opening and said body so as to make contact with and so as to form a seal between said opening and said spout at all times, said spout extending vertically with said passage in alignment with said opening in said opened position, said spout extending within said groove in said closed position, said groove and said spout being of such dimension that in said closed position said spout is incapable of being directly engaged by the hand of the user so as to be moved from said closed position toward said open position, in which the improvement comprises:

said end means comprising an external surface of revolution having its axis coincident with said horizontal axis, and engagement means for use in engaging said spout with a tool so as to rotate said spout from said closed position to a position in which said spout can be manually engaged so as to be manipulated to said open position located on said surface of revolution in a position in which it is impossible to apply a vertically directed force to it to rotate the spout from said closed position, said groove being defined by parallel, spaced side walls and a rear wall, said body includes a front end wall spaced from said side walls, said rear end wall and said front end wall fit closely against the ends of said spout when said spout is in said closed position, said front end wall including a projection serving as a latch overlying said second of said ends of said spout, said front end wall being sufficiently flexible so as to be capable of being deformed so as to permit rotation of said spout from said closed position and into said closed position, said spout and said projection are formed so as to automatically deflect said front end wall when said spout is moved into said closed position, and said engagement means comprising a notch extending parallel to said horizontal axis located in said end means, said notch being located in vertical alignment with said opening when said spout is in said closed position, said notch including a vertically extending rear wall facing away from said first of said ends of said spout.

* * * * *